US005823767A

United States Patent [19]

Watanabe et al.

[11] Patent Number: 5,823,767

[45] Date of Patent: Oct. 20, 1998

[54] PAINT DRYING FURNACE

[75] Inventors: Makoto Watanabe; Isao Ohashi, both of Tokyo; Hisashi Umeda, Aichi-ken; Koji Hayashi, Nagoya, all of Japan

[73] Assignee: Taikisha Ltd, Tokyo, Japan

[21] Appl. No.: 849,405

[22] PCT Filed: Oct. 2, 1996

[86] PCT No.: PCT/JP96/02884

§ 371 Date: Aug. 8, 1997

§ 102(e) Date: Aug. 8, 1997

[87] PCT Pub. No.: WO91/12691

PCT Pub. Date: Apr. 10, 1997

[30] Foreign Application Priority Data

Oct. 4, 1995 [JP] Japan ..... 7-257348

[51] Int. Cl.[6] ..... F27D 17/00

[52] U.S. Cl. ..... 432/72; 432/59

[58] Field of Search ..... 432/72, 59, 8

[56] References Cited

U.S. PATENT DOCUMENTS

| | | | |
|---|---|---|---|
| 4,092,100 | 5/1978 | Phillips | 432/72 |
| 4,164,819 | 8/1979 | Devillard | 34/72 |
| 4,324,545 | 4/1982 | Hubbert | 432/72 |
| 4,656,758 | 4/1987 | Nakayama | 432/152 |
| 4,662,840 | 5/1987 | Ellison | 432/72 |
| 4,670,994 | 6/1987 | Takata et al. | 34/39 |
| 4,771,707 | 9/1988 | Robson et al. | 432/72 |
| 5,568,692 | 10/1996 | Crompton et al. | 34/270 |
| 5,588,222 | 12/1996 | Thompson | 432/72 |

FOREIGN PATENT DOCUMENTS

| | | |
|---|---|---|
| 60-193272 | 12/1985 | Japan . |
| 61-129066 | 6/1986 | Japan . |
| 61-161173 | 7/1986 | Japan . |
| 61-174967 | 8/1986 | Japan . |
| 61-142294 | 9/1986 | Japan . |
| 290970 | 3/1990 | Japan . |
| 2139067 | 5/1990 | Japan . |
| 348696 | 5/1991 | Japan . |
| 4141273 | 5/1992 | Japan . |
| 531435 | 2/1993 | Japan . |
| 556195 | 8/1993 | Japan . |
| 7155672 | 6/1995 | Japan . |

*Primary Examiner*—Teresa J. Walberg
*Assistant Examiner*—Gregory Wilson
*Attorney, Agent, or Firm*—Fulbright & Jaworski

[57] ABSTRACT

Disclosed is a paint drying furnace for baking and drying paint films on painted objects following a painting process. In the furnace of the invention, a shunt gas passage is provided for dividing a gas outputted from inner gas passages of a radiator means from a position of a radiator circulating gas passage upstream of a connecting point of a fresh air passage and mixing this divided gas into the gas circulating through the furnace interior circulating gas passage. With provision of this shunt gas passage, a combustion type radiator heating device acts also as furnace interior heating means.

7 Claims, 4 Drawing Sheets

PRIOR ART

PAINT DRYING FURNACE

TECHNICAL FIELD

This invention relates to paint drying furnaces for baking and drying paint films on painted objects following a painting process, and more particularly to a paint drying furnace having furnace interior circulating gas passages for withdrawing furnace gases from furnace interiors and returning the withdrawn gas to the furnace interiors again, furnace interior heating means for heating, to a high temperature, the gases returned from the furnace interior circulating gas passages to the furnace interiors to heat the furnace interiors, hot gas heat source type radiator means with surfaces heated by passing a heat source hot gas through inner gas passages to radiate heat from the radiating surfaces to a furnace interior, a radiator circulating gas passage for returning a gas outputted from the inner gas passages of the radiator means, to the inner gas passages of the radiator means again, a combustion type radiator heating device mounted on the radiator circulating gas passage for heating the gas circulating through the radiator circulating gas passage, and a fresh air passage connected to a gas passage portion of said radiator circulating gas passage which transmits the gas outputted from the inner gas passages of the radiator means, to the combustion type radiator heating device, for mixing fresh air into the gas circulating through the radiator circulating gas passages, said combustion type radiator heating device being a direct heating type, combustion type heating device for burning a fuel directly in an atmosphere of the gas circulating through said radiator circulating gas passage.

BACKGROUND ART

Conventionally, as shown in FIG. 5, a paint drying furnace as noted above has, apart from a combustion type radiator heating device 19*a* mounted on a radiator circulating gas passage 20, and acting as furnace interior heating means Ha for heating, to a high temperature, gas RA' returned from a furnace interior circulating gas passage 9*a* to a furnace interiors 1*a*, a combustion type furnace interior heating device 19a' disposed on the furnace interior circulating gas passage 9*a* for heating gas RA circulating through the furnace interior circulating gas passage 9*a* by burning operation of a burner b.

For the radiator circulating gas passage 20 having gas PA circulating therein and containing no paint solvent vapor generated in the furnace interior during baking and drying treatment, the combustion type radiator heating device 19*a* mounted thereon comprises a direct heating type, combustion type heating device (i.e. the type for burning a fuel directly in the atmosphere of the circulating gas PA to be heated) which is advantageous in terms of thermal efficiency. On the other hand, for the furnace interior circulating gas passage 9*a* having gas RA circulating therein and containing paint solvent vapor generated in the furnace interior, the combustion type furnace interior heating device 19a' mounted thereon comprises an indirect heating type, combustion type heating device in which burning flames and combustion gas G produced by the burning operation of burner b and the gas RA circulating through the furnace interior circulating gas passage 9*a* to be heated exchange heat in a non-contact mode through an inner heat exchanger hx.

It has been necessary to employ, as the above combustion type furnace interior heating device 19*a*', an indirect heating type, combustion type heating device in which burning flames and combustion gas G, and the gas RA to be heated exchange heat in a non-contact mode, in order to avoid a situation in which the paint solvent vapor included in the gas RA circulating through the furnace interior circulating gas passage 9*a* is directly exposed and reacts to the burning flames in the combustion type heating device 19*a*', to produce a reaction product which lowers paint film quality (i.e. a reaction product which adheres to the paint films after return to the furnace interiors 1*b*, 1*c* to lower paint film quality).

In FIG. 5, 7 denotes radiator means for radiating heat to the furnace interior by passing the gas PA' heated by the combustion type radiator heating device 19*a*, as a heat source hot gas through inner gas passages ip.

18*a* denotes a fresh air passage for mixing fresh air OA (usually ambient air) into the gas RA circulating through the radiator circulating gas passage 20.

21' denotes an exhaust passage of a radiator system for discharging from the system part of the gas PA circulating through the radiator circulating gas passage 20, in a quantity corresponding to the fresh air introduced through the fresh air passage.

8*a* denotes a furnace interior exhaust passage for discharging as exhaust gas EA from the system, part of furnace interior gas ZA withdrawn from the furnace interior 1*a*.

18*a*' denotes a fresh air passages for mixing fresh air OA (usually ambient air) in a quantity corresponding to the exhaust gas from the furnace interior exhaust gas passage 8*a* into the gas RA circulating through the furnace interior circulating gas passage 9*a* to dilute the solvent vapor produced in the furnace interior 1*a*.

However, the above conventional furnace discharges from the system the combustion gas G retaining a large amount of heat after the heat exchange in the indirect heating type, combustion type heating device 19*a*' with the gas RA circulating through the furnace interior circulating gas passage 9*a* (specifically, the circulating gas mixed with fresh air OA), and thus involves a great heat loss. Further, part of the gas PA circulating through the radiator circulating gas passage 20 and retaining a large amount of heat is discharged from the system, which involves a great heat loss. Moreover, the indirect heating type, combustion type heating device 19*a*' including the inner heat exchanger hx has a large heat capacity, and requires a large heating load in start-up times. These points pose a problem of high running cost.

In addition, the indirect heating type, combustion type furnace interior heating device 19*a*', with the inner heat exchanger hx, has a large, complicated construction, which poses a problem of requiring high apparatus cost and large installation space.

Having regard to the state of the prior art noted above, a primary object of this invention is to reduce the heat loss noted above while preventing formation of a reaction product which lowers paint film quality.

Another object is to reduce the heating load in start-up times, and yet to downsize and simplify the apparatus construction.

SUMMARY OF THE INVENTION

The above objects are fulfilled by the invention defined in the claims.

That is, a paint drying furnace of this invention is a paint drying furnace noted in the outset hereof and characterized by:

a furnace interior circulating gas passage for withdrawing a furnace interior gas from a furnace interior and returning the withdrawn gas to the furnace interior again;

furnace interior heating means for heating, to a high temperature, the gas returned from this furnace interior circulation gas passage to the furnace interior, thereby to heat the furnace interior;

hot gas heat source type radiator means with radiating surfaces heated by passing a heat source hot gas through inner gas passages to radiate heat from the radiating surfaces to the furnace interior;

a radiator circulating gas passage for returning a gas outputted from the inner gas passages of this radiator means to the inner gas passages of the radiator means;

a combustion type radiator heating device disposed on this radiator circulating gas passage for heating the gas circulating through the radiator circulating gas passage; and a fresh air passage connected to a gas passage portion of said radiator circulating gas passage which transmits the gas outputted from the inner gas passages of said radiator means to said combustion type radiator heating device, for mixing fresh air into the gas circulating through the radiator circulating gas passage;

wherein a shunt gas passage is provided for dividing the gas outputted from the inner gas passages of said radiator means, from a position of said radiator circulating gas passage upstream of a connecting point of said fresh air passage, and mixing this divided gas into the gas circulating through said furnace interior circulating gas passage;

with provision of this shunt gas passage, said combustion type radiator heating device acting also as said furnace interior heating means.

According to this invention, a mode of heating, to a high temperature, the gas to be returned from the furnace interior circulating gas passage to the furnace interior is employed, in which a hot, cleaned gas containing no reaction product lowering paint film quality is mixed from the radiator circulating gas passage through the shunt gas passage into the gas circulating through the furnace interior circulating gas passage. This minimizes heat loss. Moreover, it reliably avoids the problem that the reaction product lowering paint film quality mixes into the furnace interior heating gas returned from the furnace interior circulating gas passage to the furnace interior. Preferably, said combustion type radiator heating device is a direct heating type, combustion type heating device for burning a fuel directly in an atmosphere of the gas circulating through said radiator circulating gas passage.

With this construction, the gas circulating through the furnace interior circulating gas passage and containing paint solvent vapor not passed through the direct heating type, combustion type heating device. It is therefore unnecessary for the furnace interior circulating gas passage to include, as means for heating the furnace interior, an indirect heating type, combustion type heating device which discharges, from the system, the combustion gas retaining a large amount of heat after a heat exchange with the circulating gas to be heated. Heat loss is markedly reduced as a whole since the mode is employed in which the hot, cleaned gas is divided and supplied from the radiator circulating gas passage through the shunt gas passage into the furnace interior circulating gas passage for heating the furnace interior, in place of the conventional mode in which part of the gas circulating through the radiator circulating gas passage is discharged from the system, while retaining a large amount of heat, and in a quantity corresponding to the fresh air introduced from the fresh air passage. Further, the heating load in start-up times is reduced since an indirect heating type, combustion type heating device is not required which has an increased heat capacity with an inner heat exchanger provided. Consequently, running cost may be reduced markedly, compared with the conventional furnace.

In addition, the entire construction is made simple and compact since no indirect heating type, combustion type heating device is required which has a large and complicated construction with an inner heat exchanger provided. Thus, compared with the conventional furnace, the apparatus cost may be reduced and the required installation space may be diminished.

In this invention, a combustion type exhaust cleaning device may be provided for burning paint solvent vapor contained in exhaust gas from the furnace interiors to clean the exhaust gas, and a heat recovering heat exchanger may be provided for allowing a heat exchange between the exhaust gas cleaned by this exhaust cleaning device and the fresh air to preheat the fresh air, said fresh air passage acting as a gas passage for mixing the fresh air preheated at said heat recovering heat exchanger, into the gas circulating through said radiator circulating gas passage.

With this construction, in burning a fuel in the direct heating type, combustion type heating device disposed on the radiator circulating gas passage as the combustion type heating means acting also as furnace interior heating means, in the atmosphere of the gas mixture of the gas outputted from the inner gas passages of the radiator means and the fresh air supplied from the fresh air passage, this fresh air has been preheated for mixing into the gas outputted from the inner gas passages of the radiator means. Compared with a mode of mixing fresh air without being preheated, a gas mixture of higher temperature may be supplied to the direct heating type, combustion type heating device while checking a temperature reduction of the gas mixture due to the fresh air mixing. This improves the combustion efficiency of the combustion type heating device to promote a reduction in the running cost more effectively.

Further, in this invention, said shunt gas passage may include a combustion type auxiliary heating device for further heating the gas circulating through said shunt gas passage.

With this construction, a furnace interior heating amount and a heat radiating amount of the radiator means may be adjusted independently of each other according to required furnace operating conditions by a combination of a burning amount adjustment for the combustion type radiator heating device disposed on the radiator circulating gas passage and a burning amount adjustment for the combustion type auxiliary heating device disposed on the shunt gas passage. This realizes an improved baking and drying performance of the furnace.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

DETAILED DESCRIPTION OF PREFERRED EMBODIMENTS

Figure 1:
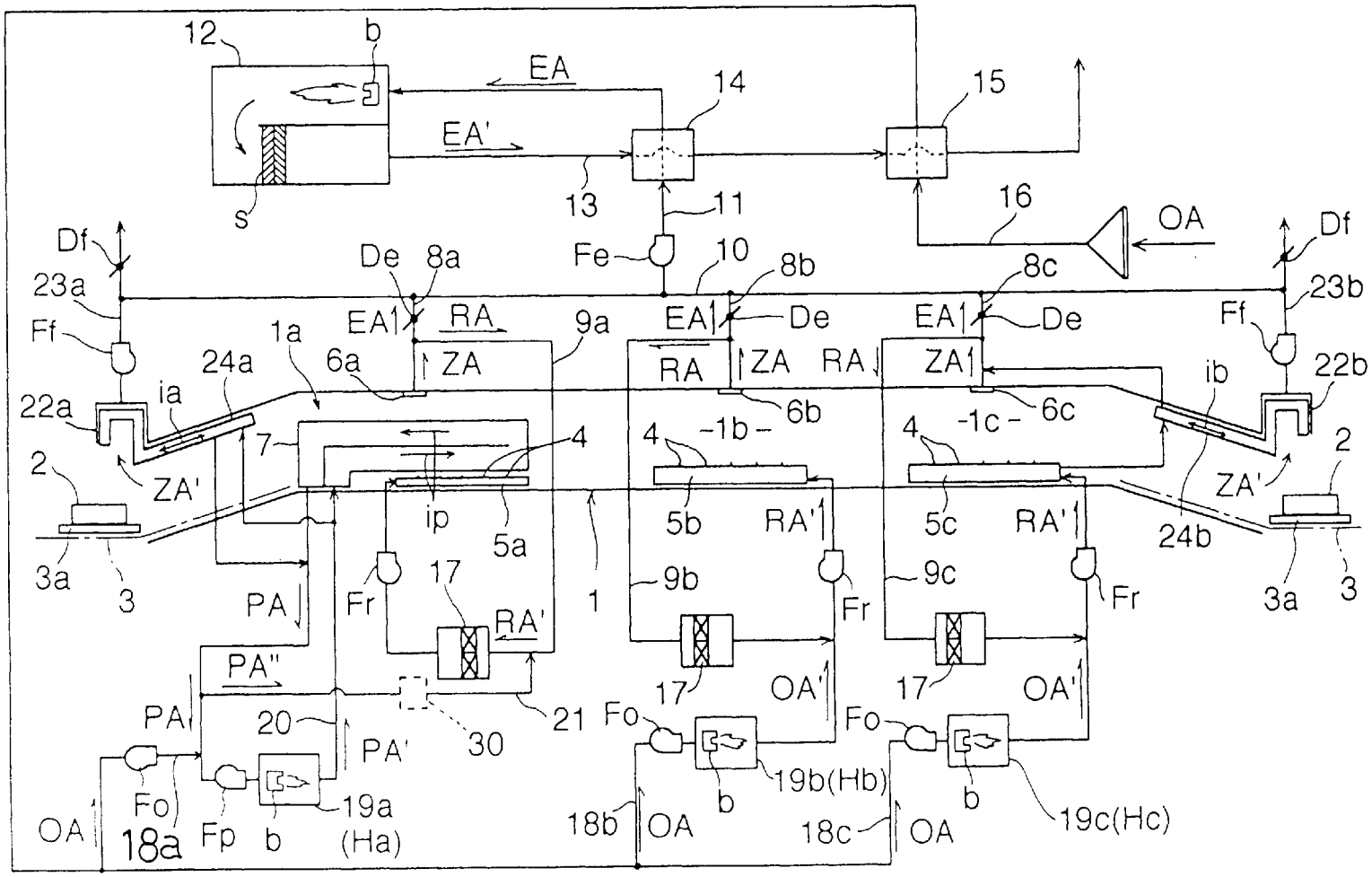
FIG. 1 is a view of an entire furnace.

In FIG. 1, 1 denotes a paint drying furnace for baking and drying paint films on painted objects 2 (which are automobile bodies in this example) following a painting process. The painted objects 2 mounted on carts 3*a* are transported by a conveyor apparatus 3 successively through a temperature increasing zone 1*a*, a first heat retaining zone 1*b* and a second heat retaining zone 1*c* in the furnace.

The respective zones 1*a*, 1*b*, 1*c* in the furnace have gas supply chambers 5*a*, 5*b*, 5*c* defining a plurality of hot gas supply openings 4, and exhaust openings 6*a*, 6*b*, 6*c* for withdrawing zone interior gases ZA. The temperature increasing zone 1*a* has, in addition to the gas supply chamber 5*a* and exhaust opening 6*a*, radiator panels 7 for radiating heat to the painted objects 2.

The zone interior gases ZA withdrawn through the exhaust openings 6*a*, 6*b*, 6*c* are divided into parts to be led as zone exhaust gases EA to furnace interior exhaust gas passages 8*a*, 8*b*, 8*c* assigned to the respective zones, and parts to be led as zone circulating gases RA to furnace interior circulating gas passages 9*a*, 9*b*, 9*c* assigned to the respective zones. The exhaust gases EA led to the furnace interior exhaust gas passages 8*a*, 8*b*, 8*c* are collected into an exhaust gas collection passage 10, and transmitted through a main exhaust gas passage 11 to a combustion type exhaust cleaning device 12. Fe denotes an exhaust fan.

The exhaust cleaning device 12 includes a burner b and catalyst layers s. This exhaust cleaning device 12 cleans the exhaust gas EA by burning paint solvent vapor (i.e. paint solvent vapor generating from paint films as a result of a baking and drying process in the furnace) contained in the exhaust gas EA under catalysis. Cleaned exhaust gas EA' is outputted to an exhaust gas discharge passage 13.

14 denotes a heat recovering heat exchanger at a hot side for allowing a heat exchange between the untreated exhaust gas EA transmitted through the main exhaust gas passage 11 to the exhaust cleaning device 12 and the hot, cleaned exhaust gas EA' outputted to the exhaust gas discharge passage 13 after the burning treatment, thereby to preheat the untreated exhaust gas EA transmitted to the exhaust cleaning device 12.

15 denotes a heat recovering heat exchanger at a cold side for allowing a heat exchange between fresh air OA (which is ambient air drawn from outside in this example) introduced through a main fresh air passage 16 and the cleaned exhaust gas EA' in the exhaust gas discharge passage 13 after passing through the heat recovering heat exchanger 14 at the hot side, thereby to preheat the fresh air OA. The cleaned exhaust gas EA' after being used for preheating the fresh air OA in the heat recovering heat exchanger 15 at the cold side is discharged from the system through the exhaust gas discharge passage 13.

Each furnace interior circulating gas passage 9*a*, 9*b*, 9*c* has a downstream end thereof connected to the gas supply chamber 5*a*, 5*b*, 5*c* of the corresponding zone, and a filter 17 for cleaning circulating gas RA and a fan Fr for causing the circulation mounted in intermediate positions thereof.

Individual fresh air passages 18*a*, 18*b*, 18*c* for the respective zones 1*a*, 1*b*, 1*c* are branched from the main fresh air passage 16. Each of these fresh air passages 18*a*, 18*b*, 18*c* has a fan Fo mounted thereon for drawing the fresh air. Of these fresh air passages 18*a*, 18*b*, 18*c*, the fresh air passages 18*b*, 18*c* for the first and second heat retaining zones 1*b*, 1*c* are connected to the furnace interior circulating gas passages 9*b*, 9*c* of the corresponding zones.

The fresh air passages 18*b*, 18*c* for the first and second heat retaining zones 1*b*, 1*c* have, acting as furnace interior heating means Hb, Hc for the respective heat retaining zones 1*b*, 1*c*, combustion type furnace interior heating devices 19*b*, 19*c* arranged upstream of points of passage connection to the furnace interior circulating gas passages 9*b*, 9*c* for heating passing fresh air OA by burning operation of burners b. The combustion type furnace interior heating devices 19*b*, 19*c* employed are the direct heating type for burning a fuel directly in the atmosphere of fresh air OA flowing through the fresh air passages 18*b*, 18*c*.

That is, for the first and second heat retaining zone 1*b*, 1*c*, hot fresh air OA' (in particular, air containing combustion gas) heated by the combustion type furnace interior heating devices 19*b*, 19*c* is mixed into the gases RA circulating through the furnace interior circulating gas passages 9*b*, 9*c*, thereby heating, to a high temperature, the gases RA' returned to the heat retaining zones 1*b*, 1*c* from the furnace interior circulating gas passages 9*b*, 9*c* (i.e., gas mixtures of the zone circulating gas RA and hot fresh air OA'). The gases RA' heated to a high temperature are delivered as hot gases from the hot gas supply openings 4 of gas supply chambers 5*b*, 5*c* into the heat retaining zones to heat the heat retaining zones by convection, thereby to adjust the interior temperatures of the respective heat retaining zones 1*b*, 1*c* to a predetermined temperature and to dilute the solvent vapor generated in the respective heat retaining zones 1*b*, 1*c*.

For the temperature increasing zone 1*a*, on the other hand, radiator panels of the hot gas heat source type are employed as radiator panels 7, in which radiating surfaces 7*a* are heated by passing a heat source hot gas through inner gas passages ip to radiate heat from the radiating surfaces 7*a* to the painted objects 2. A radiator circulating gas passage 20 is provided to return gas PA outputted from the inner gas passages ip of the radiator panels 7, to the inner gas passages ip of the radiator panels 7. A combustion type radiator heating device 19*a* is mounted on the radiator circulating gas passage 20 for heating the gas PA circulating through the radiator circulating gas passage 20 by burning operation of a burner b. The combustion type radiator heating device 19*a* employed is the direct heating type, as are the combustion type furnace interior heating devices 19*b*, 19*c* for the first and second heat retaining zones 1*b*, 1*c*, for burning a fuel directly in the atmosphere of gas PA circulating through the radiator circulating gas passage 20.

A shunt gas passage 21 is branched from a gas passage portion of the radiator circulating gas passage 20 which leads the gas PA outputted from the inner gas passages ip of radiator panels 7 to the combustion type radiator heating device 19*a*. The shunt gas passage 21 is connected to the furnace interior circulating gas passage 9*a* of the temperature increasing zone 1*a*. The fresh air passage 18*a* for the temperature increasing zone 1*a* is connected to the radiator circulating gas passage 20 in a position closer to the combustion type radiator heating device 19*a* than a branching position of the shunt gas passage 21. Fp denotes a circulating fan mounted in the radiator circulating gas passage 20.

That is, for the temperature increasing zone 1*a*, the combustion type radiator heating device 19*a* heats a gas mixture of the remainder of the gas PA outputted from the radiator panels 7, after part thereof is branched off into the shunt gas to passage 21, and the fresh air OA supplied through the fresh air passage 18*a*. The heated gas PA' (in particular, a gas containing combustion gas) is passed through the inner gas passages ip of radiator panels 7 to radiate heat from the radiating surfaces 7*a* of radiator panels 7 to the painted objects 2.

The hot gas PA branched off into the shunt gas passage 21 is mixed into the gas RA circulating through the furnace interior circulating gas passage 9*a* of the temperature increasing zone 1*a* to heat, to a high temperature, the gas RA' (i.e. a gas mixture of zone circulating gas RA of the temperature increasing zone 1*a*and hot gas PA" supplied from the shunt gas passage 21) returned from the furnace interior circulating gas passage 9*a* to the temperature increasing zone 1*a*. The gas RA' heated to a high temperature is delivered as hot gas from the hot gas supply openings 4 of gas supply chamber 5*a* into the temperature increasing zone to heat the temperature increasing zone by convection, thereby to adjust the interior temperature of the temperature increasing zone 1*a* to a predetermined temperature. At the same time, the gas mixture is introduced from the shunt gas passage 21 as a fresh gas into the temperature increasing zone 1*a* to dilute the solvent vapor generated therein.

That is, zone heating of the temperature increasing zone 1*a* is done by employing a mode in which the gas RA' returning from the furnace interior circulating gas passage 9*a* to the furnace interior 1*a* is heated to a high temperature by dividing and supplying the hot gas PA" by the shunt gas passage 21 from the radiator circulating gas passage 20 to the furnace interior circulating gas passage 9*a* as noted above. Thus, the combustion type radiator heating device 19*a* on the radiator circulating gas passage 20 is made to serve also as furnace interior heating means Ha for the temperature increasing zone.

In short, for the first and second heat retaining zones 1*b*, 1*c*, while using the direct heating type, combustion type furnace interior heating devices 19*b*, 19*c*, fresh air OA containing no paint solvent vapor is heated by the combustion type furnace interior heating devices 19*b*, 19*c*. A furnace interior heating mode is employed in which the heated fresh air OA' is mixed into the gases RA circulating through the furnace interior circulating gas passages 9*b*, 9*c* to heat the zone interiors. For the temperature increasing zone 1*a* including the radiator panels 7, a furnace interior heating mode is employed in which part of the hot clean gas PA in the radiator circulating gas passage 20 containing no paint solvent vapor is divided, and the divided hot clean gas PA" is mixed into the gas RA circulating through the furnace interior circulating gas passage 9a to heat the furnace interior. By employing these, the paint solvent vapor contained in the gases RA circulating through the furnace interior circulating gas passages 9*a*, 9*b*, 9*c* is exposed and reacts to burning flame in the direct heating type, combustion type heating devices, to produce a reaction product which would lower paint film quality. It is possible to avoid a situation where the reaction product mixes into the gases returning to the furnace interiors from the furnace interior circulating gas passages 9*a*, 9*b*, 9*c*.

On the other hand, hoods 22*a*, 22*b* are arranged at the inlet and outlet of the furnace, respectively, for collecting furnace interior gases ZA' leaking out through the inlet and outlet. Hood exhaust gas passages 23*a*, 23*b* connected to these hoods 22*a*, 22*b* include hood gas exhaust fans Ff and gas passage opening and shutting dampers Df. The exhaust gas collection passage 10 is connected to the hood exhaust gas passages 23*a*, 23*b* in positions closer to the hoods than the gas passage opening and shutting dampers Df.

That is, in a regular operation as an operating mode of the furnace to perform baking and drying treatment of the painted objects 2 in the furnace, gas passage opening and shutting dampers De of the furnace interior exhaust gas passages 8*a*, 8*b*, 8*c* of the respective zones 1*a*, 1*b*, 1*c* are opened, and gas passage opening and shutting dampers Df of the hood exhaust gas passages 23*a*, 23*b* are closed. Consequently, exhaust gases EA from the respective zones 1*a*, 1*b*, 1*c* and gases ZA' collected by the hoods 22*a*, 22*b* are transmitted to the exhaust cleaning device 12, and the exhaust cleaning device 12 burns the paint solvent vapor contained in these exhaust gases EA and collected gases ZA'.

In a start-up operation as a stage preceding the regular operation to increase the zone temperatures of the respective zones 1*a*, 1*b*, 1*c* to the predetermined temperatures with no painted objects 2 present in the furnace yet, the gas passage opening and shutting dampers De of the furnace interior exhaust gas passages 8*a*, 8*b*, 8*c* of the respective zones 1*a*, 1*b*, 1*c* are closed to stop the exhaust gases from the respective zones 1*a*, 1*b*, 1*c*, thereby to expedite start-up of the zone temperatures. On the other hand, the gas passage opening and shutting dampers Df of the hood exhaust gas passages 23*a*, 23*b* are opened, whereby the hood exhaust fans Ff cause the gases ZA' collected by the hoods 22*a*, 22*b* (i.e. gases not containing paint solvent vapor yet) to be discharged to a fixed discharge location through the hood exhaust gas passages 23*a*, 23*b*.

24*a*, 24*b* in the drawing denote panel heaters for preventing the paint solvent vapor in the furnace interior gases from condensing on ceilings adjacent the inlet and outlet of the furnace. By preventing condensation of the paint solvent vapor with theses panel heaters 24*a*, 24*b*, a situation is avoided where condensed paint solvent drips on the painted objects 2 to lower paint film quality. Moreover, this assures that paint solvent vapors adjacent the inlet and outlet of the furnace are promptly collected along with the furnace interior gases ZA' by the hoods 22*a*, 22*b* and transmitted to the exhaust cleaning device 12.

The panel heaters 24*a*, 24*b* employed are the hot gas heat source type to pass heat source hot gases through inner gas passages 1*a*, 1*b*. For the panel heater 24*a* at the furnace inlet, part of the hot gas PA' transmitted through the radiator circulating gas passage 20 from the combustion type radiator heating device 19*a* to the radiator panels 7 is supplied as heat source hot gas to the inner gas passage 1*a* of panel heater 24*a* The gas having passed through the inner gas passage ia of panel heater 24*a* is joined to the gas PA outputted from the radiator panels 7. For the panel heater 24*b* at the furnace outlet, part of the hot gas RA' supplied to the gas supply chamber 5*c* in the second heat retaining zone 1*c* is supplied as heat source hot gas to the inner gas passage ib of panel heater 24*b*. The gas having passed through the inner gas passage ib of panel heater 24*b* is joined to the gas ZA withdrawn from the zone 1*c* through the exhaust opening 6*c*.

Figure 2:
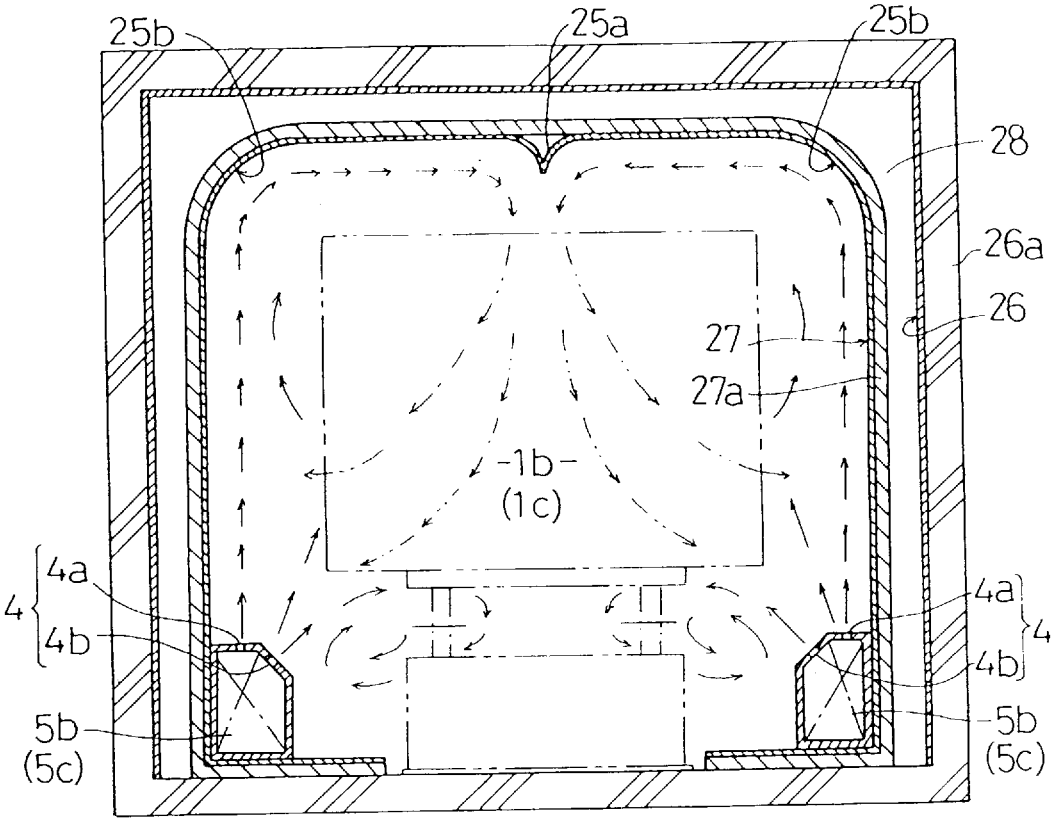
FIG. 2 is a sectional view of a heat retaining zone.

FIG. 2 shows a specific inner structure of the first and second heat retaining zones 1*b*, 1*c*. As shown in FIG. 2, a pair of gas supply chambers 5*b*, 5*c* extending in the direction of transport of the painted objects 2 are arranged at opposite, left and right ends in the zone bottom. Each of these gas supply chambers 5*b*, 5*c* defines, as the hot gas supply openings 4, upward supply openings 4*a* for blowing hot gas RA' upward along a furnace wall, and oblique supply openings 4*b* for blowing hot gas RA' obliquely upward toward the right and left center in the zone.

Figure 3:
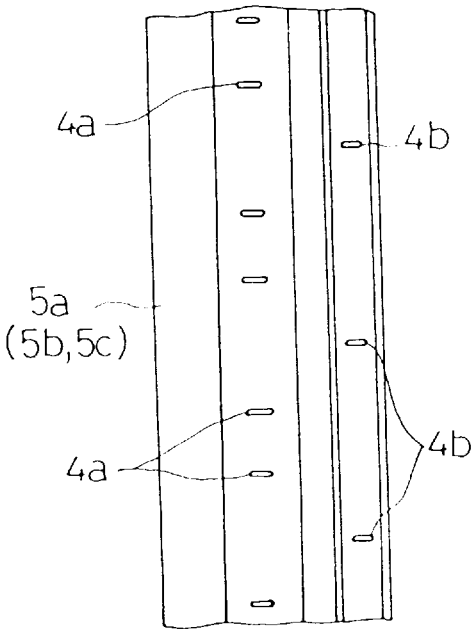
FIG. 3 is a plan view showing hot gas supply openings.

As shown in FIG. 3, these upward supply openings 4*a* and oblique supply openings 4*b* are arranged in respective rows in the direction of transport of the painted objects 2, with each opening in the form of a slit. Gas flow guides 25*a*, 25*b* extending in the direction of transport of the painted objects 2 are formed at the right and left center of the zone ceiling and at opposite, right and left ends of the zone ceiling for guiding zone interior gas flows as shown in arrows in the drawing. A furnace wall structure comprises a double wall structure including an outer wall panel 26 with an insulating material 26*a* applied thereto, and an inner wall panel 27 with an insulating material 27*a* applied thereto, an insulating layer of air 28 being formed between the inner and outer walls.

While the gas supply chambers 5*b*, 5*c* are arranged in the zones as described above, as for the exhaust side, exhaust chambers are omitted and each heat retaining zone 1*a*, 1*b* has one or two exhaust openings 6*b*, 6*c* opening at the right and left center of the zone ceiling. By omitting exhaust chambers in this way, each heat retaining zone 1*a*, 1*b* has a reduced heat capacity to diminish a start-up heating load during an initial period of operation.

Figure 4:
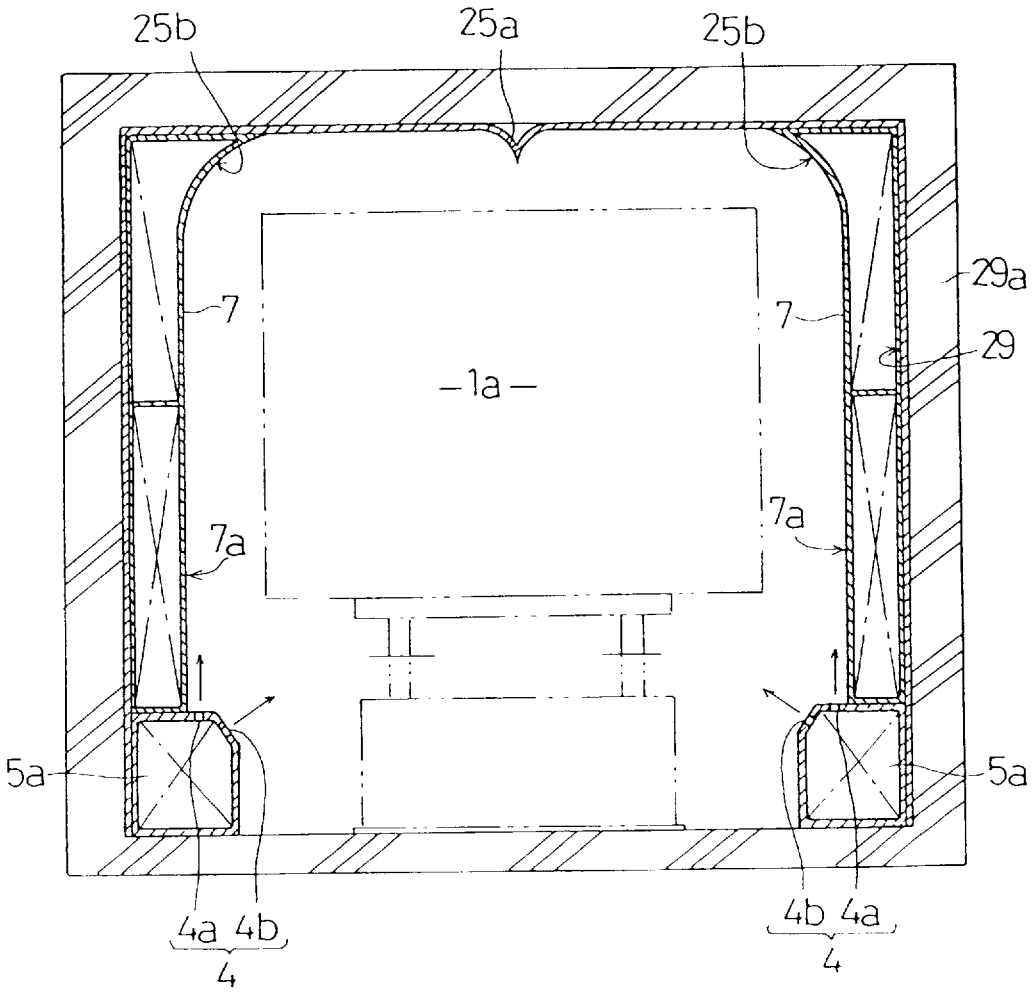
FIG. 4 is a sectional view of a temperature increasing zone.
Figure 5:
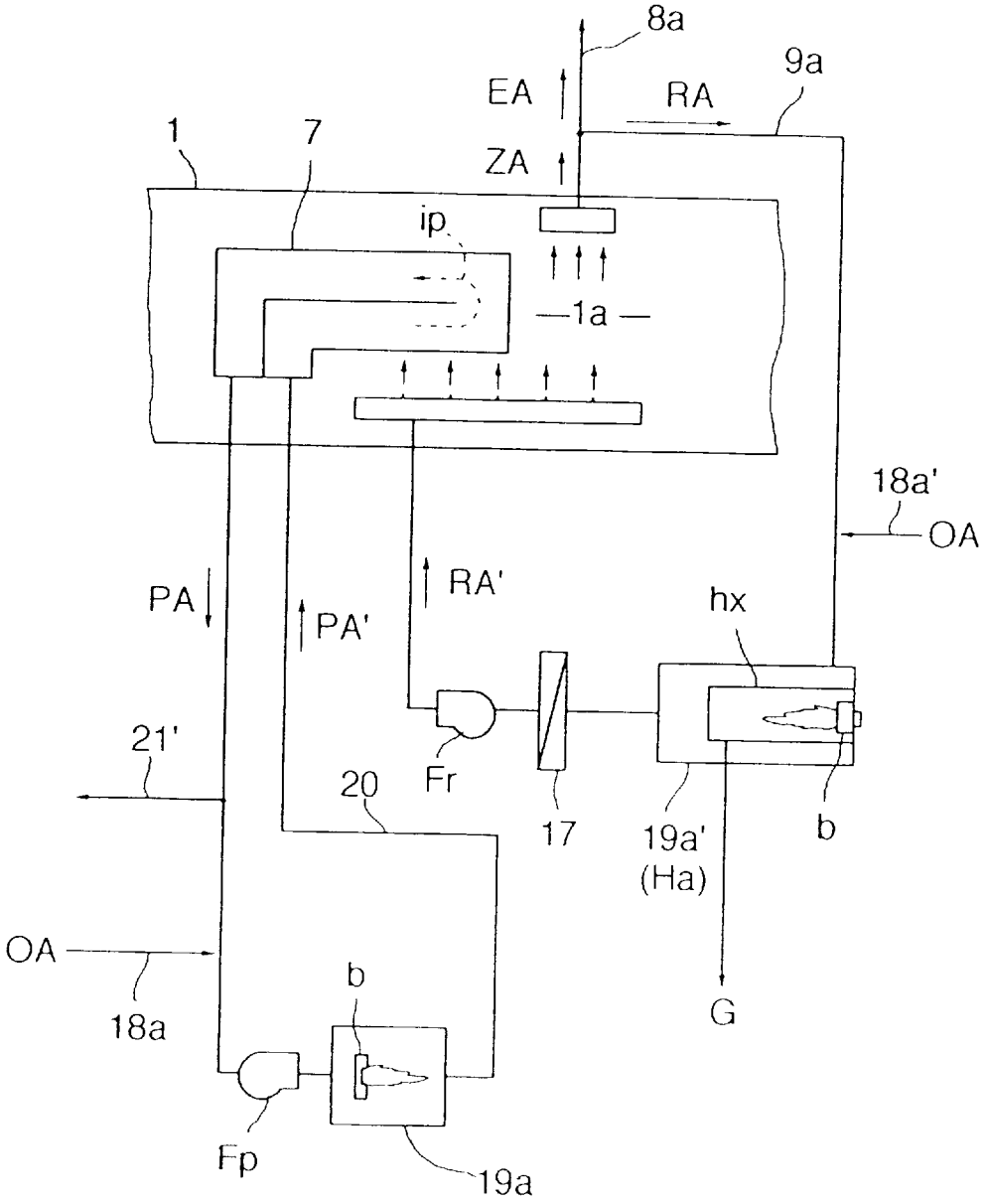
FIG. 5 is a view of a furnace showing the prior art.

On the other hand, a specific inner structure of the temperature increasing zone 1*a*, as shown in FIG. 4, has a pair of gas supply chambers 5*a* extending in the direction of transport of the painted objects 2 and arranged at opposite, right and left ends of the zone bottom. Each of these gas supply chambers 5*a* defines upward supply openings 4*a* and oblique supply openings 4*b* as in the heat retaining zones 1*b*, 1*c*. The radiator panels 7 are arranged on opposite furnace walls above these gas supply chambers 5*a*.

Gas flow guides 25*a*, 25*b* are provided as in the heat retaining zones 1*b*,1*c*. As for the exhaust, exhaust chambers are omitted as in the heat retaining zones 1*b*, 1*c*, and one or two exhaust openings 6*a* open at the right and left center of the zone ceiling. By omitting exhaust chambers in this way, large areas of the radiating surfaces 7*a* are secured for the radiator panel 7.

In the furnace wall structure of temperature increasing zone 1*a* in the example shown in FIG. 4, the furnace wall in the temperature increasing zone 1*a*is formed only of a single wall panel 29 with an insulating material 29*a* applied thereto. Where appropriate, a double wall structure as in the heat retaining zones 1*b*, 1*c* may be employed also for the temperature increasing zone 1*a*.

(1) As shown in broken lines in FIG. 1, the shunt gas passage 21 may include an auxiliary heating device 30 for heating the gas PA" circulating through the shunt gas passage 21. Since the gas PA" circulating through the shunt gas passage 21 is a gas containing no paint solvent vapor, the auxiliary heating device 30 may be the direct heating type or indirect heating type.

(2) In the foregoing embodiment, the invention defined in claim 1 is applied to the temperature increasing zones 1*a* in the furnace. In a furnace construction in which the furnace interior is divided into a plurality of zones, the invention defined in claim 1 may be applied to all of these zones. The invention defined in claim 1 may be applied to a furnace construction having no divided zones.

(3) In the foregoing embodiment, ambient air is used as fresh air OA. Fresh air OA may be varied types of air as long as furnace interior gas ZA is not contained, such as indoor air of a painting plant, or cleaned exhaust air from a different apparatus.

(4) The inner structure of the furnace is not limited to the inner structures shown in FIGS. 2 and 4 but may be varied in may ways.

We claim:

1. A paint drying furnace having a furnace interior, the furnace comprising:

a furnace interior circulating gas passage for withdrawing a furnace interior gas from the furnace interior and returning the withdrawn gas to the furnace interior;

furnace interior heating means for heating, to a high temperature, the gas returned from the furnace interior circulation gas passage to the furnace interior, thereby to heat the furnace interior;

hot gas heat source type radiator means with radiating surfaces heated by passing a heat source hot gas through inner gas passages to radiate heat from the radiating surfaces to the furnace interior;

a radiator circulating gas passage for returning a gas outputted from the inner gas passages of the radiator means to the inner gas passages of the radiator means;

a combustion type radiator heating device disposed on the radiator circulating gas passage for heating the gas circulating through the radiator circulating gas passage;

a fresh air passage connected to a gas passage portion of said radiator circulating gas passage which transmits the gas outputted from the inner gas passages of said radiator means to said combustion type radiator heating device for mixing fresh air into the gas circulating through the radiator circulating gas passage;

a shunt gas passage for dividing the gas outputted from the inner gas passages of said radiator means from a position of said radiator circulating gas passage upstream of a connecting point of said fresh air passage and mixing this divided gas into the gas circulating through said furnace interior circulating gas passage; and with provision of this shunt gas passage, said combustion type radiator heating device acting also as said furnace interior heating means.

2. The paint drying furnace of claim 1 wherein said combustion type radiator heating device is a direct heating type, combustion type radiator heating device for burning a fuel directly in an atmosphere of the gas circulating through said radiator circulating gas passage.

3. The paint drying furnace of claim 2 further comprising a combustion type exhaust cleaning device for burning paint solvent vapor contained in exhaust gas from the furnace interiors to clean the exhaust gas.

4. The paint drying furnace of claim 3 further comprising a heat recovering heat exchanger for a heat exchange between the exhaust gas cleaned by the exhaust cleaning device and the fresh air to preheat the fresh air.

5. The paint drying furnace of claim 4 wherein said fresh air passage acting as a gas passage for mixing the fresh air preheated at said heat recovering heat exchanger, into the gas circulating through said radiator circulating gas passage.

6. The paint drying furnace of claim 2 wherein said shunt gas passage includes a combustion type auxiliary heating device for further heating the gas circulating through said shunt gas passage.

7. The paint drying furnace of claim 6 wherein said auxiliary heating device is a direct heating type or indirect heating type heating device.

* * * * *